US006666730B2

(12) United States Patent
Canuto et al.

(10) Patent No.: US 6,666,730 B2
(45) Date of Patent: Dec. 23, 2003

(54) ELECTRIC CONNECTOR, WITH CONTACT POSITIONING ELEMENTS

(75) Inventors: Oscare Canuto, Collegno (IT); Roberto Martini, Turin (IT)

(73) Assignee: Tyco Electronics AMP Italia, S.p.A. (IT)

( * ) Notice: Subject to any disclaimer, the term of this patent is extended or adjusted under 35 U.S.C. 154(b) by 0 days.

(21) Appl. No.: 10/098,283

(22) Filed: Mar. 14, 2002

(65) Prior Publication Data

US 2002/0146936 A1 Oct. 10, 2002

(30) Foreign Application Priority Data

Mar. 16, 2001 (IT) ..... TO01A0247

(51) Int. Cl.[7] ..... H01R 13/514
(52) U.S. Cl. ..... 439/752; 439/752.5; 439/598
(58) Field of Search ..... 439/701, 752, 439/752.5, 638, 598, 678, 682, 686, 352, 353, 354, 851, 852

(56) References Cited

U.S. PATENT DOCUMENTS 5,643,015 A * 7/1997 Wakata ..... 439/701
6,325,680 B1 * 12/2001 Suzuki ..... 439/852

* cited by examiner

*Primary Examiner*—Lynn Feild
*Assistant Examiner*—Son V. Nguyen

(57) ABSTRACT

The invention relates to an electric connector for use in vehicles. The connector comprises a first connector body having a first housing, a first opening, and a first projecting portion and a second connector body having a second housing, a second opening, and a second projecting portion. Pluralities of contacts have indented portions such that when the contacts are correctly inserted into the first and second housings, the indented portions correspond with the first and second openings. As a result, when the second connector body is received in the first connector body the first projecting portion is received in the second opening and the second projecting portion is received in the first opening to reciprocally couple the first and second connector bodies.

17 Claims, 4 Drawing Sheets

ELECTRIC CONNECTOR, WITH CONTACT POSITIONING ELEMENTS

BACKGROUND OF THE INVENTION

This invention relates to an electric connector and, more particularly, to an electric connector used in wiring harnesses aboard vehicles.

DESCRIPTION OF THE PRIOR ART

An electric connector normally comprises a plastic material connector body having a plurality of housings in which respective electrical contacts are inserted. In many types of connectors, the contacts are clipped into the respective housings.

One of the most frequent causes of failure in electrical systems aboard vehicles derives from the imperfect fastening of the contacts in the housings on the connector body. Often a connector with an imperfectly fastened contact will pass the initial electric test. Resultantly, this contact may later interrupt the electric connection with a similar contact in working conditions due to movements generated by vibrations, thermal dilatation, etc. For this reason, after assembly of the contacts in the connector body, it is often necessary to check that the contacts are correctly arranged in the respective housings.

A traditional way of testing the correct assembly of the contacts consists in forming small indented portions on the contacts. When the contacts are correctly fitted in the respective housings, the indented portions are arranged to correspond with a passing opening formed in the connector body. Correct assembly of the contacts is tested by coupling the connector with a test device equipped with a projecting portion that is inserted in the passing opening in the connector body. The test device is constructed so that if at least one of the contacts is not correctly arranged in the housing, an interference occurs preventing the reciprocal coupling of the connector and the test device.

A problem associated with the described test method is that test reliability depends solely on the individual carrying out the test, because it is not possible to know whether the finished connector has passed the test or not by mere examination. It is therefore desirable to develop a connector that overcomes the aforesaid problem.

SUMMARY OF THE INVENTION

The invention relates to an electric connector for use in the electric connection between the electric system of a vehicle and the electric devices and controls arranged on the steering wheel of the vehicle. The connector comprises a first connector body and a second connector body. The first connector body having a first housing, a first opening, and a first projecting portion. The second connector body having a second housing, a second opening, and a second projecting portion. A plurality of contacts having indented portions such that when the contacts are correctly inserted into the first and second housings, the indented portions correspond with the first and second openings. As a result, when the second connector body is received in the first connector body the first projecting portion is received in the second opening and the second projecting portion is received in the first opening to reciprocally couple the first and second connector bodies.

BRIEF DESCRIPTION OF THE DRAWINGS

The invention will now be described by way of example with reference to the accompanying figures wherein.

DETAILED DESCRIPTION OF THE PREFERRED EMBODIMENT

Figure 1:
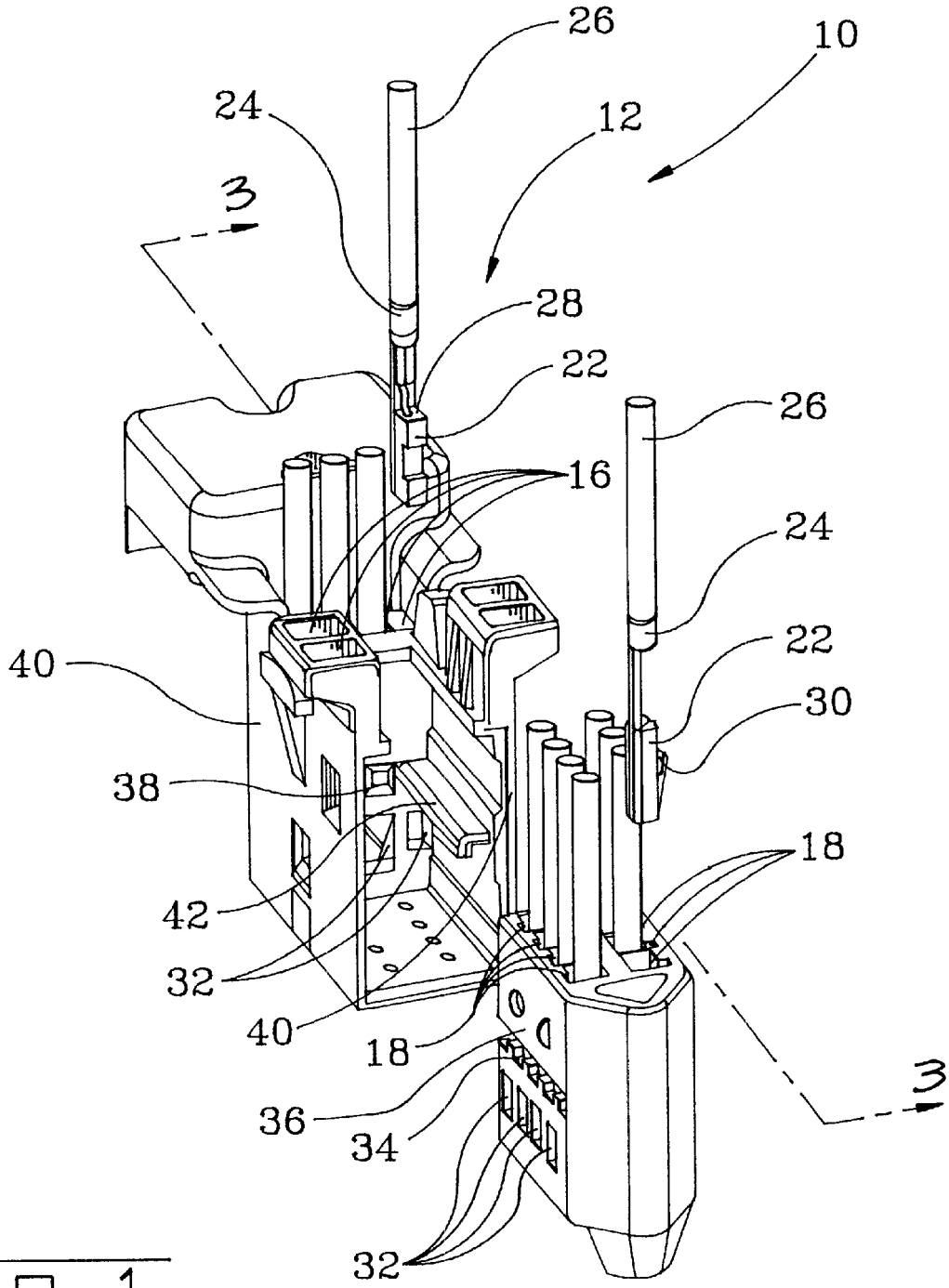
FIG. 1 is a perspective front side view of a connector according to the present invention.
Figure 2:
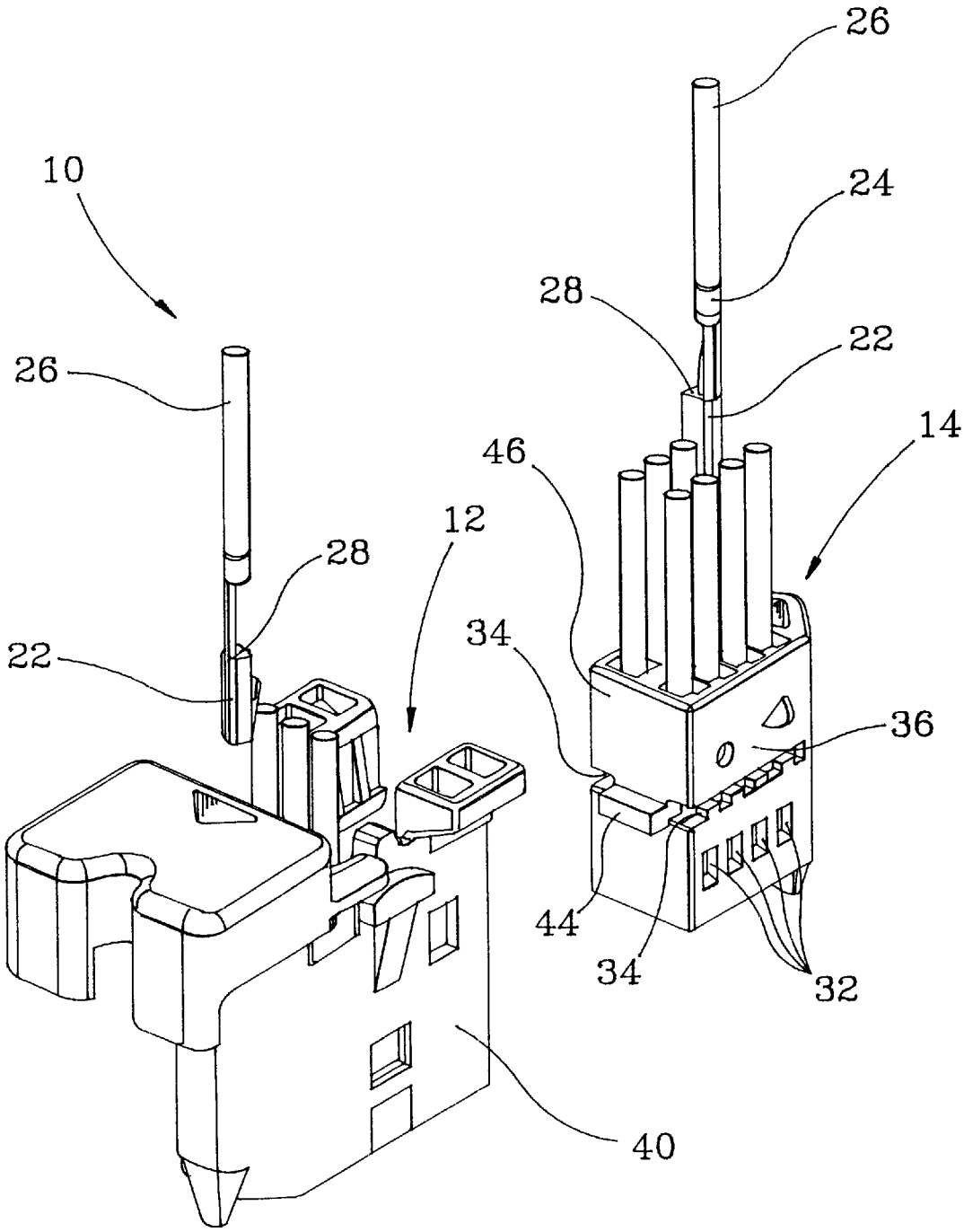
FIG. 2 is a perspective rear side view of the connector in FIG. 1.

Shown in FIGS. 1 and 2 is an electric connector 10 comprising a first connector body 12 and a second connector body 14. The first connector body 12 has substantially the shape of a parallelepiped enclosure, open on two sides, for receipt of the second connector body 14. The first and second connector bodies 12, 14 are both made of injection moulded plastic material and have contact housings 16, 18 for receiving electric contacts 22. In the embodiment illustrated for the purpose of example in the drawings, the first connector body 12 has four contact housings 16. The second connector body 14 has eight contact housings 18 arranged in two parallel rows, each formed with four contact housings 18.

Each contact 22 has a portion 24 that is crimped onto an isolating sheath of an electric conductor 26. Each contact 22 has, on a lateral side, an indented portion 28 and a clip-on engagement element 30 that engages a hole 32 in the first and second connector bodies 12, 14 to anchor each contact 22 to the respective housing 16, 18.

The second connector body 14 has a pair of slots 34 formed on the lateral sides 36 and arranged over the respective array of the holes 32. Each of the slots 34 communicates with the adjacent housings 18. The slots 34 are arranged so that, if the contacts 22 are correctly positioned and engaged in the respective housings 18, the indented portion 28 of each contact 22 corresponds to the slot 34. Conversely, if one of the contacts 22 is not correctly engaged in the respective housings 18, a part of the contact 22 that is not indented, would correspond to the slot 34.

The first connector body 12 has a similar slot 38, partially visible in FIG. 1. The slot 38 communicates with the housings 16 and the contacts 22 such that when the contacts 22 are correctly inserted in the housings 16, the contacts 22 are positioned with the indented portion 28 corresponding to the slot 38.

The first connector body 12 has a pair of parallel sides 40, defining the sides of the enclosure that receive the second connector body 14. When the second connector body 14 is received in the first connector body 12, the lateral sides 36 of the second connector body 14 are in contact with the internal surfaces of the parallel sides 40. Each of the parallel sides 40 of the first connector body 12 has a rib 42 that projects inwards and is arranged for insertion in the corresponding slot 34 when the first and second connector bodies 12, 14 are coupled.

The second connector body 14 has a rib 44 that projects from a front side 46 and is perpendicular to the lateral sides 36 on which the slots 34 are formed. The rib 44 is received in the corresponding slot 38 when the first and second connector bodies 12, 14 are coupled.

Figure 3:
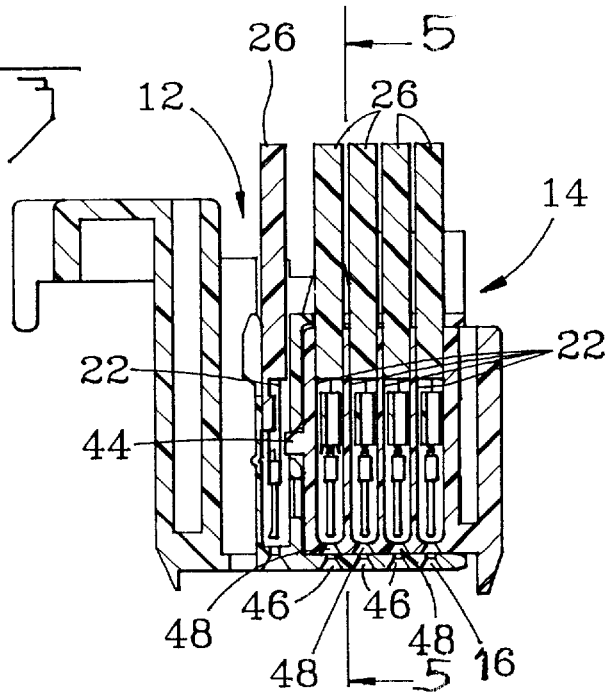
FIG. 3 is a cross-sectional view taken along line 3—3 in FIG. 1, illustrating the connector in an assembled configuration.
Figure 4:
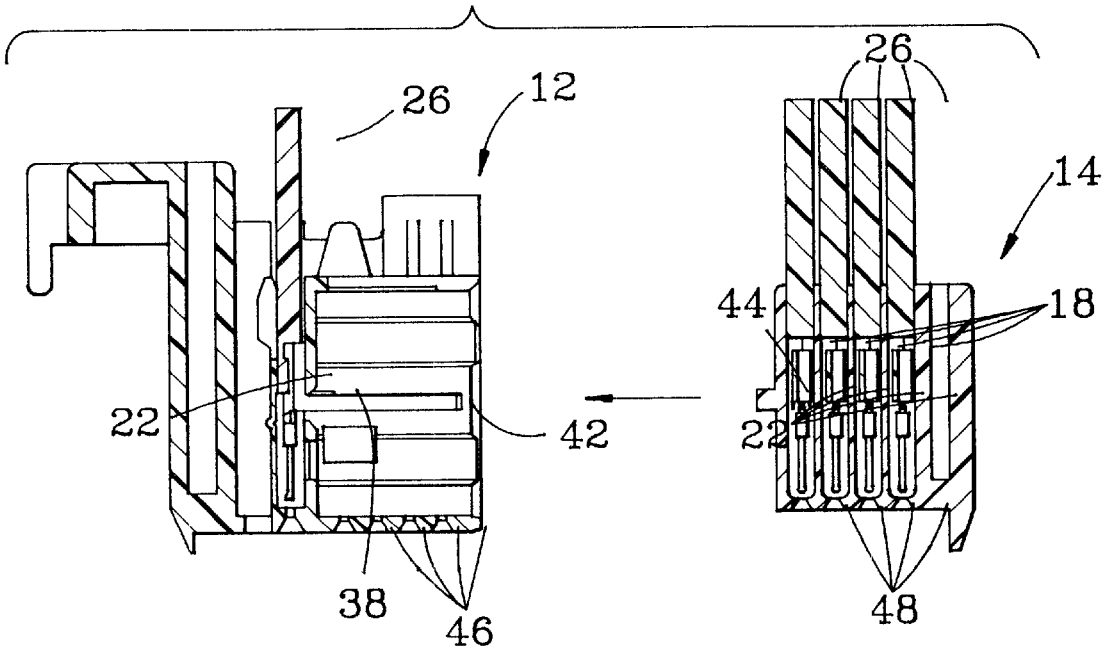
FIG. 4 is a cross-sectional view taken along line 3—3 in FIG. 1, illustrating the two components of the connector in a released condition.
Figure 5:
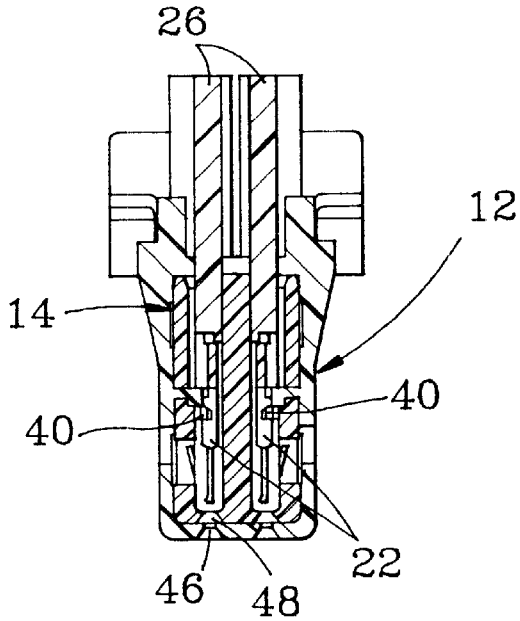
FIG. 5 is a cross-sectional view taken along line 5—5 in FIG. 3.

Shown in FIGS. 3 and 4, when the contacts 22 are correctly engaged in the respective housings 16, 18 nothing can obstruct the engagement of the ribs 42 in the slots 34 and the engagement of the rib 44 in the slot 38. Consequently, when the second connector body 14 is inserted in the first connector body 12, the first and second connector bodies 12, 14 are coupled to form the complete connector 10 shown in FIG. 3. The first and second connector bodies 12, 14 are equipped with holes 46, 48 on the respective bottom sides. The holes 46, 48 are respectively aligned when the first and second connector bodies 12, 14 are correctly coupled. The simple fact that the first and second connector bodies 12, 14 are correctly engaged indicates that the contacts 22 are correctly fastened in the housings 16, 18. Consequently, a test is not required to verify correct positioning and fastening of the contacts 22.

Figure 6:
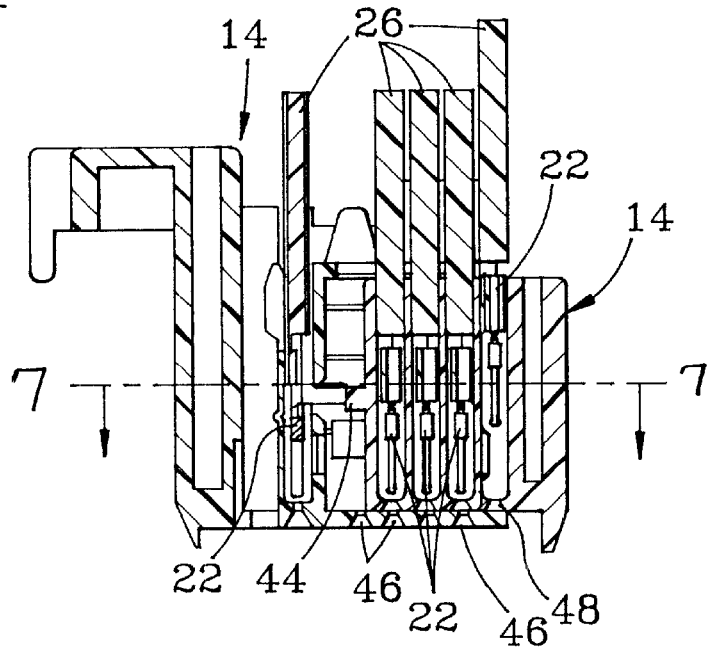
FIG. 6 is a cross-sectional view taken along line 3—3 in FIG. 1, illustrating a condition where the contact is not arranged properly.
Figure 7:
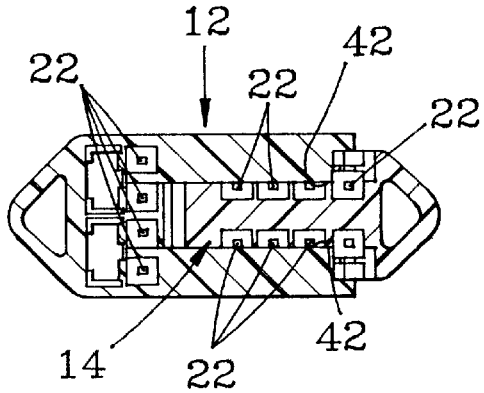
FIG. 7 is a cross-sectional view taken along line 7—7 in FIG. 6.

FIGS. 6 and 7 illustrate an example in which two contacts 22 are not correctly fastened in the respective housings 18. As shown in FIG. 7, the non-indented part of the contacts 22 obstructs the insertion of the ribs 42 inside the slots 34 and the ribs 42 come into contact with the side surface of the contacts 22. In FIG. 6, the first and second connector bodies 12, 14 are not correctly coupled. Because part of the second connector body 14 projects out from the first connector body 12, the holes 46, 48, therefore, are not aligned. In this condition, the dimensions of the connector 10 make fitting in a complementary housing impossible, clearly demonstrating that the connector 10 was not correctly assembled. The same situation occurs when one of the contacts 22 is not correctly fastened in one of the housings 16 of the first connector body 12. The only difference being that the rib 44 interferes with the non-indented part of the contact 22 that is not correctly positioned.

Naturally, numerous changes can be implemented to the construction and forms of embodiment of the invention herein described, all comprised within the context of the concept characterising this invention, as defined by the following claims.

We claim:

1. An electric connector for vehicles, comprising:

a first connector body having a first contact housing, a first opening, and a first projecting portion;

a second connector body having a second contact housing, a second opening corresponding to the first projecting portion, and a second projecting portion corresponding to the first opening;

a plurality of contacts having indented portions such that when the contacts are inserted into the first contact housing, the indented portions correspond with the first opening and when the contacts are inserted into the second contact housing, the indented portions correspond with the second opening; and the first projection and the second projection are formed such that the first projecting portion and the second projecting portion are sequentially received in their corresponding openings when the second connector body is reciprocally coupled to the first connector body;

wherein when the contacts are correctly arranged in their respective housings, the first projecting portion is received in the second opening and the second projecting portion is received in the first opening.

2. The electric connector of claim 1, wherein the first connector body has a first side having a plurality of first apertures and the second connector body has a second side having a plurality of second apertures, the first apertures and the second apertures arranged such that when the first connector body and the second connector body are reciprocally coupled, the first apertures and the second apertures align.

3. The electric connector of claim 1, wherein the first connector body and the second connector body have holes positioned substantially adjacent to the first openings and the second openings for anchoring the contacts.

4. The electric connector of claim 3, wherein the contacts have engagement elements that engage in the holes to anchor the contacts.

5. The electric connector of claim 1, wherein the first contact housing is reciprocally aligned with other first contact housings.

6. The electric connector of claim 1, wherein the second contact housing is arranged in parallel rows with other second contact housings.

7. An electric connector for vehicles, comprising:

a first connector body having a first contact housing, a first opening, and a first projecting portion;

a second connector body having a second contact housing, a second opening, and a second projecting portion;

a plurality of contacts having indented portions such that when the contacts are inserted into the first and second contact housings, the indented portions correspond with the first and second openings; and the first projecting portion and the second projecting portion are formed to be essentially perpendicular to each other;

wherein when the second connector body is received in the first connector body the first projecting portion is received in the second opening and the second projecting portion is received in the first opening to reciprocally couple the first and second connector bodies when the contacts are correctly arranged in the first and second housings.

8. The electric connector of claim 7, wherein the first connector body has a first side having a plurality of first apertures and the second connector body has a second side having a plurality of second apertures, the first apertures and the second apertures arranged such that when the first connector body and the second connector body are reciprocally coupled, the first apertures and the second apertures align.

9. The electric connector of claim 7, wherein the first connector body and the second connector body have holes positioned substantially adjacent to the first openings and the second openings for anchoring the contacts.

10. The electric connector of claim 9, wherein the contacts have engagement elements that engage in the holes to anchor the contacts.

11. The electric connector of claim 7, wherein the first contact housing is reciprocally aligned with other first contact housings.

12. The electric connector of claim 7, wherein the second contact housing is arranged in parallel rows with other second contact housings.

13. An electric connector for vehicles, comprising:

a first connector body having a first contact housing, a first opening, a first side, and a first projecting portion;

a second connector body having a second contact housing, a second opening, a second side, and a second projecting portion;

the first side having a plurality of first apertures, and the second side having a plurality of second apertures, the first apertures and the second apertures arranged such that when the first connector body and the second connector body are reciprocally coupled, the plurality of first apertures communicate with the plurality of second apertures when aligned therewith; and a plurality of contacts having indented portions such that when the contacts are inserted into the first and second contact housings, the indented portions correspond with the first and second openings;

wherein when the second connector body is received in the first connector body the first projecting portion is received in the second opening and the second projecting portion is received in the first opening to reciprocally couple the first and second connector bodies when the contacts are correctly arranged in the first and second housings.

14. The electric connector of claim 13, wherein the first connector body and the second connector body have holes positioned substantially adjacent to the first openings and the second openings for anchoring the contacts.

15. The electric connector of claim 14, wherein the contacts have engagement elements that engage in the holes to anchor the contacts.

16. The electric connector of claim 13, wherein the first contact housing is reciprocally aligned with other first contact housings.

17. The electric connector of claim 16, wherein the second contact housing is arranged in parallel rows with other second contact housings.

* * * * *